US008641044B2

(12) United States Patent
Gruber

(10) Patent No.: US 8,641,044 B2
(45) Date of Patent: Feb. 4, 2014

(54) MULTI-DIRECTION SLOT MACHINE PAY LINES

(75) Inventor: Diane K. Gruber, Las Vegas, NV (US)

(73) Assignee: Global Gaming Group, Inc., Las Vegas, NV (US)

( * ) Notice: Subject to any disclaimer, the term of this patent is extended or adjusted under 35 U.S.C. 154(b) by 0 days.

(21) Appl. No.: 12/771,385

(22) Filed: Apr. 30, 2010

(65) Prior Publication Data

US 2011/0266745 A1 Nov. 3, 2011

Related U.S. Application Data

(60) Provisional application No. 61/175,069, filed on May 4, 2009.

(51) Int. Cl.
*A63B 71/00* (2006.01)

(52) U.S. Cl.
USPC ..... 273/143 R

(58) Field of Classification Search
None
See application file for complete search history.

(56) References Cited

U.S. PATENT DOCUMENTS

| | | | | |
|---|---|---|---|---|
| 5,580,053 | A | 12/1996 | Crouch | |
| 5,807,172 | A * | 9/1998 | Piechowiak | 463/20 |
| 6,093,102 | A | 7/2000 | Bennett | |
| 6,241,607 | B1 * | 6/2001 | Payne et al. | 463/20 |
| 6,517,433 | B2 | 2/2003 | Loose et al. | |
| 6,547,242 | B1 * | 4/2003 | Sugiyama et al. | 273/142 R |
| 6,604,999 | B2 | 8/2003 | Ainsworth | |
| 6,656,046 | B1 | 12/2003 | Yoseloff et al. | |
| 6,712,693 | B1 | 3/2004 | Hettinger | |
| 6,712,694 | B1 | 3/2004 | Nordman | |
| 6,855,054 | B2 * | 2/2005 | White et al. | 463/21 |
| 6,893,342 | B1 | 5/2005 | Singer | |
| 6,939,223 | B1 | 9/2005 | Jones | |
| 6,974,129 | B2 | 12/2005 | Nordman | |
| 7,025,674 | B2 | 4/2006 | Adams et al. | |
| 7,192,347 | B1 | 3/2007 | Marks et al. | |
| 7,351,144 | B2 | 4/2008 | Daly | |
| 7,380,791 | B2 * | 6/2008 | Gauselmann et al. | 273/142 B |
| 7,399,226 | B2 * | 7/2008 | Mishra | 463/18 |
| 7,438,639 | B2 * | 10/2008 | Osawa | 463/20 |
| 7,445,548 | B1 * | 11/2008 | Muskin | 463/20 |
| 7,473,173 | B2 * | 1/2009 | Peterson et al. | 463/20 |
| 7,481,707 | B1 * | 1/2009 | Luciano et al. | 463/19 |
| 7,497,439 | B2 * | 3/2009 | Leupp et al. | 273/138.1 |
| 7,594,848 | B2 * | 9/2009 | Thomas | 463/16 |
| 7,594,849 | B2 * | 9/2009 | Cannon | 463/16 |

(Continued)

FOREIGN PATENT DOCUMENTS

DE 3712841 A1 * 11/1988

*Primary Examiner* — Kurt Fernstrom
*Assistant Examiner* — Dolores Collins
(74) *Attorney, Agent, or Firm* — Muskin & Farmer LLC

(57) ABSTRACT

Slot machines utilize one or more pay lines on which a combination of symbols are lined up to determine whether a particular pay line wagered is a winner according to a pay table that shows winning combinations with associated pays. Players are able to place wagers or bets of varying amounts on the pay lines and the machine pays out based on the amount wagered and the number of winning pay line combinations displayed. The present invention enhances game play by offering players the opportunity to choose whether to wager on a pay line that runs right-to-left or left-to-right without changing the probabilities of winning. Or, alternatively, of offering the player the option to wager on pay lines that run in both directions with a weighting of the win probabilities.

8 Claims, 5 Drawing Sheets

(56) References Cited

U.S. PATENT DOCUMENTS

| | | | | |
|---|---|---|---|---|
| 7,601,062 | B2 * | 10/2009 | Cole et al. | 463/20 |
| 7,614,948 | B2 * | 11/2009 | Saffari et al. | 463/19 |
| 7,618,315 | B2 * | 11/2009 | Thomas et al. | 463/20 |
| 7,624,986 | B2 * | 12/2009 | Nicely | 273/146 |
| 7,628,693 | B2 * | 12/2009 | Thomas | 463/20 |
| 7,744,458 | B2 * | 6/2010 | Marks et al. | 463/20 |
| 7,758,414 | B1 * | 7/2010 | Marks et al. | 463/20 |
| 7,972,212 | B2 * | 7/2011 | Iverson et al. | 463/37 |
| 8,062,115 | B2 * | 11/2011 | Thomas et al. | 463/16 |
| 2003/0121022 | A1 * | 6/2003 | Yoshitake et al. | 716/21 |
| 2004/0224747 | A1 | 11/2004 | Okada | |
| 2004/0235542 | A1 * | 11/2004 | Stronach et al. | 463/6 |
| 2004/0242313 | A1 | 12/2004 | Munoz | |
| 2005/0054422 | A1 | 3/2005 | Rothkranz et al. | |
| 2006/0068891 | A1 * | 3/2006 | Okada | 463/20 |
| 2006/0160605 | A1 * | 7/2006 | Hornik et al. | 463/20 |
| 2007/0191087 | A1 | 8/2007 | Thomas | |
| 2007/0270208 | A1 * | 11/2007 | Caspers et al. | 463/20 |
| 2008/0045300 | A1 * | 2/2008 | Quayle et al. | 463/18 |
| 2008/0051180 | A1 | 2/2008 | Okada | |
| 2008/0146313 | A1 * | 6/2008 | Inamura | 463/20 |
| 2008/0200235 | A1 * | 8/2008 | Yoshizawa | 463/20 |
| 2008/0220839 | A1 | 9/2008 | DeBrabander | |
| 2008/0287179 | A1 * | 11/2008 | Berman et al. | 463/20 |
| 2009/0048010 | A1 | 2/2009 | Kroeckel | |
| 2009/0098927 | A1 * | 4/2009 | Nishimura et al. | 463/20 |
| 2010/0075740 | A1 * | 3/2010 | Suda | 463/20 |
| 2010/0222128 | A1 * | 9/2010 | Berman et al. | 463/20 |

* cited by examiner

| POSITION | R1 | WEIGHT | R2 | WEIGHT | R3 | WEIGHT | R4 | WEIGHT | R5 | WEIGHT |
|---|---|---|---|---|---|---|---|---|---|---|
| 0 | B_05 | 2 | B_07 | 2 | A_02 | 2 | B_07 | 2 | B_05 | 2 |
| 1 | A_03 | 2 | B_05 | 2 | C_10 | 2 | B_05 | 2 | A_03 | 2 |
| 2 | C_10 | 2 | A_03 | 2 | C_09 | 2 | A_03 | 2 | C_10 | 2 |
| 3 | A_03 | 2 | B_05 | 2 | A_02 | 2 | B_05 | 2 | A_03 | 2 |
| 4 | B_07 | 2 | B_07 | 2 | A_03 | 2 | B_07 | 2 | B_07 | 2 |
| 5 | A_02 | 1 | C_10 | 1 | B_05 | 1 | C_10 | 1 | A_02 | 1 |
| 6 | B_05 | 1 | B_06 | 1 | C_09 | 1 | B_06 | 1 | B_05 | 1 |
| 7 | C_09 | 1 | C_09 | 1 | A_01 | 1 | C_09 | 1 | C_09 | 1 |
| 8 | B_07 | 1 | A_03 | 1 | B_05 | 1 | A_03 | 1 | B_07 | 1 |
| 9 | A_01 | 1 | C_10 | 1 | B_06 | 1 | C_10 | 1 | A_01 | 1 |
| 10 | B_07 | 1 | A_02 | 1 | A_01 | 1 | A_02 | 1 | B_07 | 1 |
| 11 | C_09 | 1 | A_01 | 1 | B_05 | 1 | A_01 | 1 | C_09 | 1 |
| 12 | B_07 | 1 | B_07 | 1 | A_03 | 1 | B_07 | 1 | B_07 | 1 |
| 13 | A_02 | 2 | C_10 | 2 | B_05 | 2 | C_10 | 2 | A_02 | 2 |
| 14 | C_10 | 2 | C_09 | 2 | C_10 | 2 | C_09 | 2 | C_10 | 2 |
| 15 | A_03 | 3 | A_02 | 3 | C_09 | 3 | A_02 | 3 | A_03 | 3 |
| 16 | C_09 | 3 | C_09 | 3 | B_06 | 3 | C_09 | 3 | C_09 | 3 |
| 17 | A_01 | 3 | B_06 | 3 | A_03 | 3 | B_06 | 3 | A_01 | 3 |
| 18 | C_10 | 3 | C_09 | 3 | C_10 | 3 | C_09 | 3 | C_10 | 3 |
| 19 | A_03 | 2 | A_02 | 2 | C_09 | 2 | A_02 | 2 | A_03 | 2 |
| 20 | C_10 | 2 | A_01 | 2 | A_01 | 2 | A_01 | 2 | C_10 | 2 |
| 21 | B_06 | 2 | C_10 | 2 | B_07 | 2 | C_10 | 2 | B_06 | 2 |

*FIG. 5*

MULTI-DIRECTION SLOT MACHINE PAY LINES

CROSS-REFERENCE TO RELATED APPLICATION

This application claims the benefit of provisional patent application Ser. No. 61/175,069, filed May 4, 2009, by the present inventor, Diana Gruber, which is incorporated herein by reference in its entirety.

STATEMENT OF COPYRIGHTED MATERIAL

A portion of the disclosure of this patent document contains material which is subject to copyright protection. The copyright owner has no objection to the facsimile reproduction by anyone of the patent document or the patent disclosure, as it appears in the PTO patent file or records, but otherwise reserves all copyright rights whatsoever.

BACKGROUND OF THE INVENTION

A pay line is a line on a slot machine screen or viewing area used to determine a winner. If certain pre-defined reel symbols (e.g., three "BARS" or three "7's") stop in the positions crossed by the pay line, the player wins a factor of the amount bet according to a pay table.

Over time, the number of pay lines available to a player for play of a particular game has grown, and now multiple pay lines are a key feature in the rise of player interest in video slots. In FIG. 2, a representative example of a 5-reel video slot machine having 10 pay lines is illustrated. This example depicts the way in which pay lines on a multiple pay line slot machine sometimes zig and zag across the different reel positions displayed on the screen. Traditionally, slot machines have pay lines that read left-to-right (L-R) so that winning combinations must appear on the 1st, $2^{nd}$, $3^{rd}$, etc. reels/strips in a predetermined order to qualify. (In other words, an otherwise winning combination appearing on the $3^{rd}$, $4^{th}$ and $5^{th}$ reels/strips will not qualify as a win.)

Some prior art examples can be found on games that either have pay lines running from the far right reel/strip leftward (i.e., Right-to-Left), or else that allow the starting position of the pay lines to be shifted to the $2^{nd}$, $3^{rd}$, etc. reels/strips.

U.S. Pat. No. 7,399,226 to Mishra ('226) describes a slots game in which pay lines can run either left-to-right or right-to-left. (See Column 9, line 44-Column 10, line 12.) Mishra '226 fails to disclose arranging symbol positions and relative weights identically on the 1st and last reels (this is a three-reel game) so that odds parity occurs in either direction of the pay line.

U.S. Publication No. 2007/0191087 to Thomas et al. ('087) teaches the concept of shifting the starting reel position for purposes of pay line determination. Thomas et al. '087 does not disclose the concept of pay lines running in the direction right-to-left, nor of establishing symbol positions and relative weights identically on the 1st and 5th reels and also on the 2nd and 4th reels.

U.S. Publication No. 2008/0051180 to Okada ('180) teaches a slots game that allows, under certain circumstances, the pay line symbols to be rearranged in the event a winning combination is not achieved in the first instance in the typical left-to-right direction. (See Abstract and Paragraph [0011].) Okada '180 does not disclose matching the symbol positions and relative weights on the 1st and 5th reels (or 1st and last) and requiring the player to pre-select either left-to-right, right-to-left, or both directions of pay line flow.

U.S. Publication No. 2009/0048010 to Kroeckel et al. ('010) briefly mentions (in Paragraph [0195]) that winning combinations could pay right-to-left or left-to-right. However, Kroeckel et al. '010 does not establish the symbol positions and relative weights identically on the 1st and last reels and also on the 2nd and 4th reels so that there is no change in game odds if the player chooses to play a pay line that runs right-to-left instead of left-to-right.

Game odds and payout are strictly monitored by the local gaming commission. Accordingly, there exists a need for an improved game apparatus and method that allows the player to choose whether to play a pay line that runs right-to-left instead of left-to-right without changing the odds, or alternatively of allowing the player to choose to play pay lines that run in both directions with a mere doubling of the odds.

BRIEF DESCRIPTION OF THE DRAWINGS

FIG. 5 shows a reel map representation of a 5 reel slot machine with an example of relative symbol positions and weighs.

SPECIFICATIONS

DETAILED DESCRIPTION OF THE PREFERRED EMBODIMENT

Figure 1:
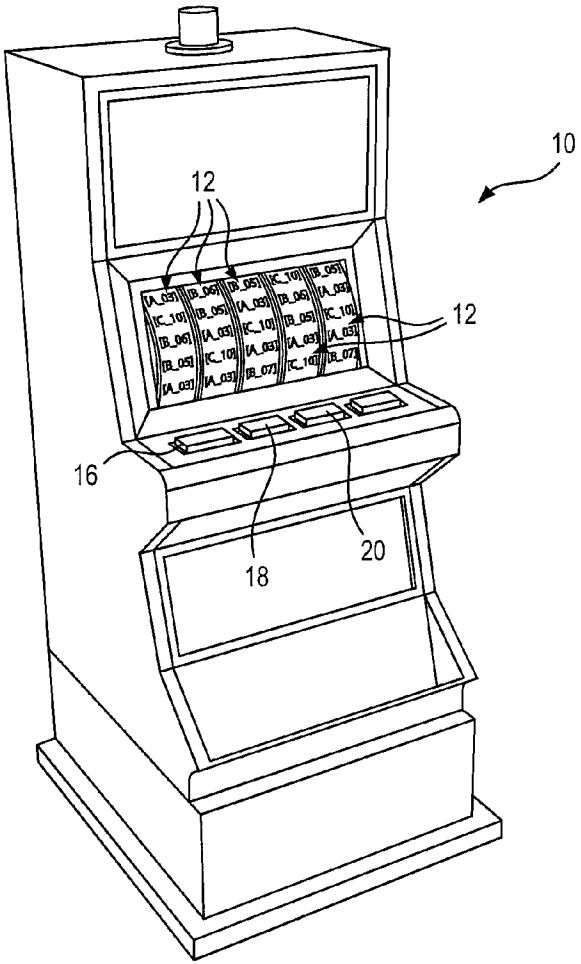
FIG. 1 is a 5 reel slot machine showing representative reel symbol combinations displayed.

Referring to FIGS. 1 and 3-5, wherein like numerals indicate like or corresponding parts throughout the several views, an exemplary slot machine is generally shown at 10 in FIG. 1. For the sake of convenience, the slot machine 10 is illustrated with mechanical reels 12 arranged side-by-side in typical fashion. The reels 12 are depicted as being of the mechanical type; however this invention is equally applicable to video slots game applications. Here, five reels 12 are shown, although the concepts of this invention can be implemented on 3, 4, and more than 5-reel machines. Of course, the reels 12 spin independently of each other.

Figure 4:
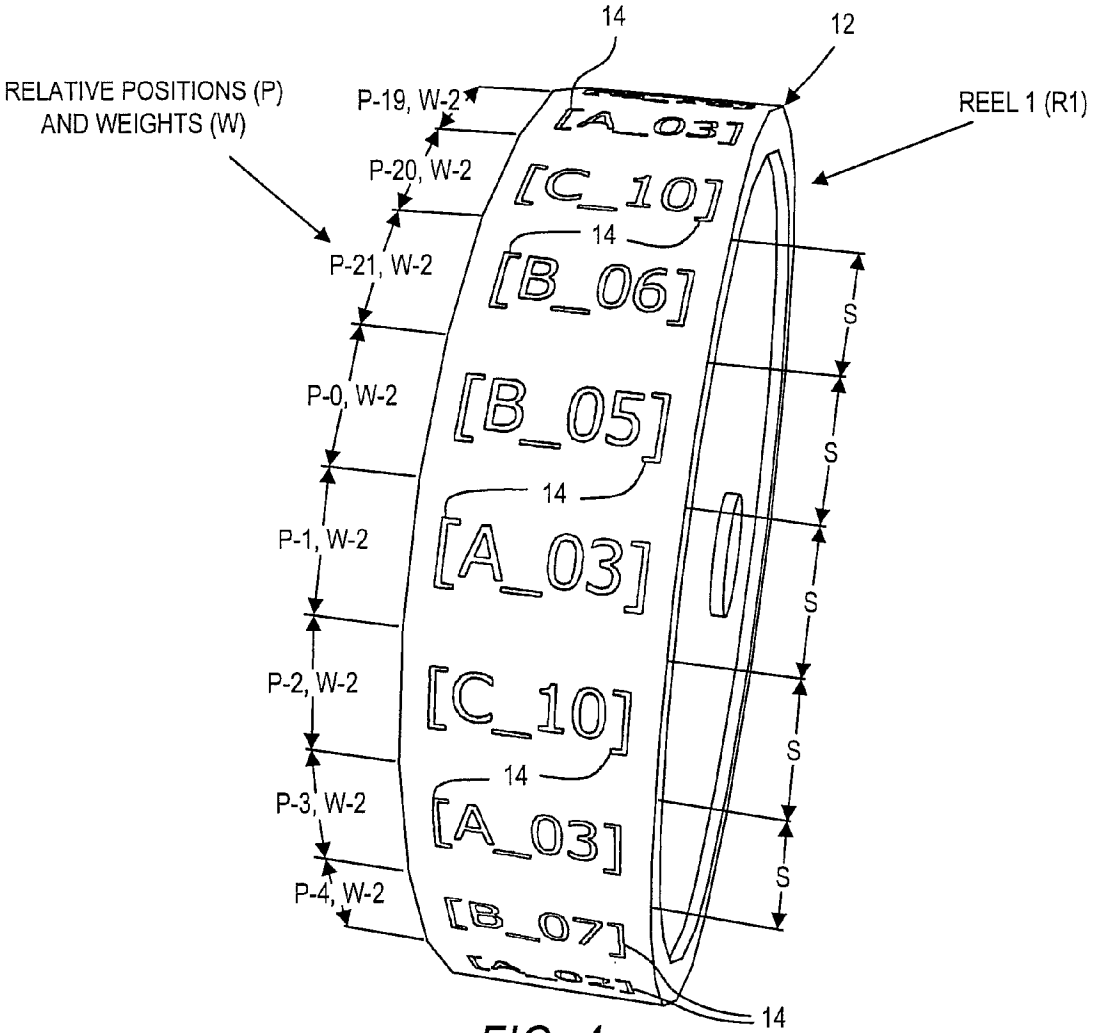
FIG. 4 shows an expanded view of a single reel of a slot machine with relative symbol positions and probability weights.

As perhaps best shown in FIG. 4, the reels 12 have a generally cylindrical construction or are graphically depicted to imitate a cylindrical or strip-like representation on a viewing screen. For purposes of illustration only, the reel 12 shown in FIG. 4 includes alpha-numeric designators 14 representative of symbols used during a play of a slots game. The symbols 14 will change from one game title to the next and are shown here as alpha-numeric designators for purposes of illustrating the underlying principles of this invention.

The reels 12, whether in actual physical three-dimensional form or as video projections, include symbols 14 which are arranged around the circumference. Each symbol 14 occupies a character space S such that its distance from the next adjacent symbol 14 is generally fixed throughout play of the game.

FIG. 5 is a table depicting the arrangement of symbols on each of the five reels 12 (R1-R5). Each Position (0-21) represents a space S about the circumference of the reel 12 (either mechanical or virtual). Thus, in the example of FIG. 5, the reels 12 have twenty-two spaces (Positions 0-21) and thus twenty-two distinct symbols 14 arranged thereabout. (Of course, it is possible for symbols 14 to repeat as dictated by the mathematics of the particular game being played.) Furthermore, each symbol 14 is provided with an associated Weight (1, 2 or 3) which affects the odds that symbol 14 will appear along the central pay line. In the example of FIG. 5, the weighting of the symbol C_09 located at position 16 of Reel 1 is "3." This weighting signifies that the mathematical probability of symbol C_09 in position 16 ending up on a particular pay line at the conclusion of a game is 3 times as likely as a symbol with a weighting of 1 ending up on the particular pay line, such as symbol A_02 located at position 5 on Reel 1 which has a weighting of "1." The differing Weights, as well as the sequence of symbols 14, affect the probabilities of symbol combinations of the game which are designed into the game system by a developer.

The basic concept of this invention is to set up the reels 12 in a multi-slot machine (either traditional mechanical reels or simulated video reels) so that the symbol "positions" and relative "weights" are identical on a matched pair of reels that are located around a middle or central reel. In the case of a 5 reel slot machine, the middle reel is the third reel or R3 in FIG. 5. The matched pairs are the 1st and last reels, and then again on the second and fourth reels. In a machine with greater numbers of reels, each reel 12 is paired with a matched counterpart—although in a game having an odd number of reels (eg., 3, 5 or 7), the center reel 12 will not have a counterpart. Thus, in the example of a 5-reel game, the symbol 14 arrangements (including sequence, Positions and Weights) will be identical on the 1st and 5th reels, and also on the 2nd and 4th reels. When set up this way, the pay line can run either direction without affecting the odds.

Take note of how the reels 12 minor each other in the sample reel layout of FIG. 5. Reel 5 (R5) looks exactly like Reel 1 (R1), and Reel 4 (R4) looks exactly like Reel 2 (R2). When slot machine reels/strips are mirrored in this way, the game will play the same whether pay lines are calculated from left-to-right or from right-to-left. The game will have exactly the same mathematical properties (i.e., Expected Value or EV) regardless of which direction a symmetrical payline is read.

Figure 2:
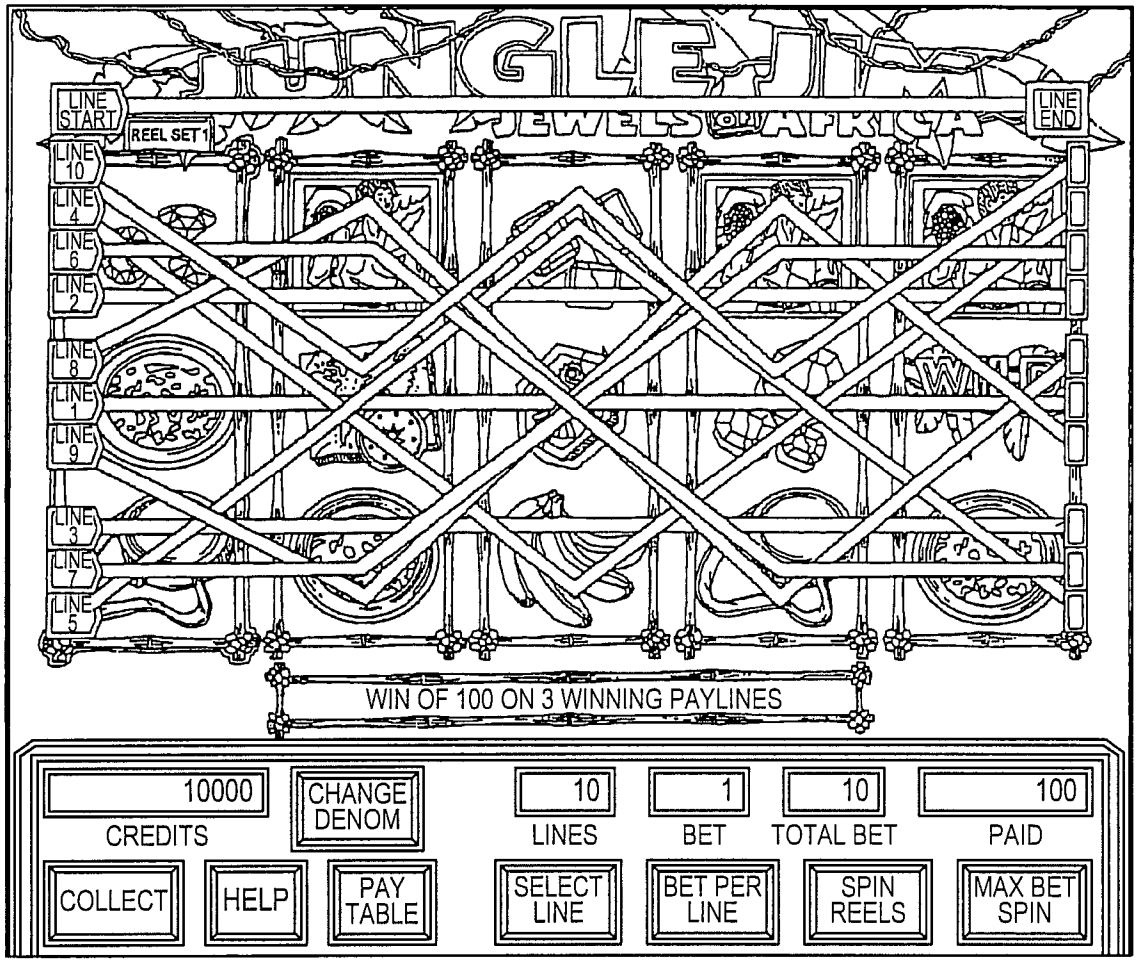
FIG. 2 PRIOR ART
FIG. 2 is a depiction of the screen of a prior art video slot machine with multiple pay lines across 5 reels.
Figure 3:
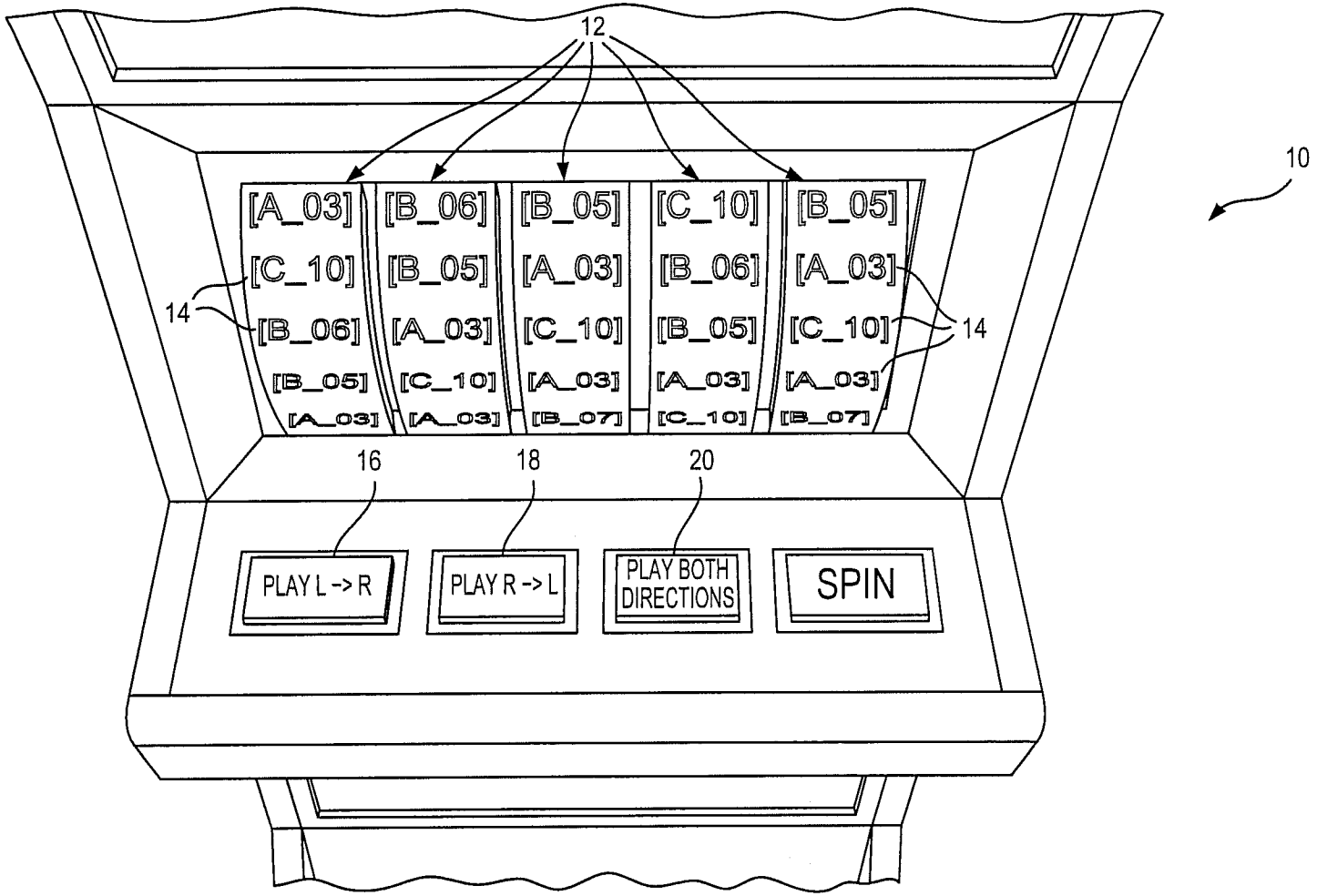
FIG. 3 is a 5 reel slot machine of FIG. 1 with an enlarged depiction of the reels.

According to this invention, the pay line direction is made a matter of player choice, provided the payline is symmetrical about a left-right center point. In the case of the pay lines shown in FIG. 2, the invention works for pay lines 1, 2, 3, 4, 5 and 10, but not for those paylines that are not left-right symmetrical around a center point like pay lines 6, 7, 8 and 9. The player will be presented with three buttons 16, 18, 20 like those shown in FIG. 3. Players will be allowed to choose whether pay line directions will run left-to-right (button 16) or right-to-left (button 18) with no change whatsoever in game odds. The player must select the direction of play before the reels are spun. (i.e., he can not choose directions after the reels have stopped.) For a simple doubling of the bet (button 20), the player can have the play lines run both directions (L-R and R-L). The player may choose which direction to play based on how he feels his luck is going, or by whatever criteria occurs to him. Mathematically, it is all the same to the game operator. So individual spins will result in different pays L-R and R-L, but EVs will be identical over the entire cycle.

If the player chooses to play both directions, it would require a bet twice the size as playing one direction. For example, if the player plays 25 lines at 20 credits per line, he would be playing 500 credits either left-to-right or right-to-left. If he chooses both directions, it would be a 1000 credit bet, and equivalent to playing 50 lines.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method of wagering on a machine, comprising:

providing, on the machine, a plurality of reels comprising five reels in which a leftmost reel and a rightmost reel are matched which comprise a plurality of symbols positioned in a same sequential order, and second reel and a fourth reel are matched which comprise a plurality of symbols positioned in a same sequential order, and a center reel which does not have a matched counterpart;

performing the following operations on the machine:

offering a player to select a payline direction from a set of options comprising at least three of the following options: 1) left, 2) right, 3) both;

receiving a selected payline direction from the player from the set of options;

initiating play on the machine using a wager and spinning the plurality of reels; and determining whether a win has occurred on one or more pay lines wagered in accordance with the selected payline direction and providing a respective payout when earned.

2. The method of claim 1 wherein the plurality of symbols on each matched pair of reels has matched weight values.

3. The method of claim 1 wherein at least one of the one or more pay lines is a straight, horizontal line configured such that the final reel stop position for each reel is aligned to be in the same relative position in the viewing area to the reel adjacent to it across all reels.

4. The method of claim 1 wherein at least one of the one or more pay lines is symmetrical about a center point.

5. A machine comprising:

a plurality of reels, the plurality of reels being either mechanical reels or virtual reels, the plurality of reels comprising five reels in which a leftmost reel and a rightmost reel are matched which comprise a plurality of symbols positioned in a same sequential order, and second reel and a fourth reel are matched which comprise a plurality of symbols positioned in a same sequential order, and a center reel which does not have a matched counterpart;

the machine configured to:

offer a player to select a payline direction from a set of options comprising at least three of the following options: 1) left, 2) right, 3) both;

receive a selected payline direction from the player from the set of options;

initiate play on the machine and spin the plurality of reels; and determine whether a win has occurred on one or more paylines wagered in accordance with the selected payline direction.

6. The machine of claim 5 wherein at least one of the one or more paylines is a straight, horizontal line configured such that the final reel stop position for each reel is aligned to be in the same relative position in the viewing area to the reel adjacent to it across all reels.

7. The machine of claim 5 wherein at least one of the one or more paylines is symmetrical about a center point.

8. The machine of claim 5 wherein at least one of the one or more paylines further comprises a configuration that is symmetrical about a center point.

* * * * *